US009257756B2

(12) United States Patent
Huynh

(10) Patent No.: US 9,257,756 B2
(45) Date of Patent: Feb. 9, 2016

(54) DUAL BAND DIRECTIVE/REFLECTIVE ANTENNA

(71) Applicant: NovAtel Inc., Calgary (CA)

(72) Inventor: Son Huy Huynh, Redondo Beach, CA (US)

(73) Assignee: NovAtel, Inc., Calgary (CA)

( * ) Notice: Subject to any disclaimer, the term of this patent is extended or adjusted under 35 U.S.C. 154(b) by 227 days.

(21) Appl. No.: 14/041,976

(22) Filed: Sep. 30, 2013

(65) Prior Publication Data

US 2015/0091773 A1 Apr. 2, 2015

(51) Int. Cl.
*H01Q 21/30* (2006.01)
*H01Q 1/48* (2006.01)
*H01Q 5/40* (2015.01)

(52) U.S. Cl.
CPC ..... *H01Q 21/30* (2013.01); *H01Q 1/48* (2013.01); *H01Q 5/40* (2015.01)

(58) Field of Classification Search
CPC ..... H01Q 19/10; H01Q 21/30; H01Q 21/29
USPC ..... 343/833, 834
See application file for complete search history.

(56) References Cited

U.S. PATENT DOCUMENTS 6,917,341 B2 * 7/2005 Ishihara et al. ..... 343/752
7,495,627 B2 * 2/2009 Parsche ..... 343/800

* cited by examiner

*Primary Examiner* — Hoang V Nguyen
(74) *Attorney, Agent, or Firm* — Cesari and McKenna, LLP

(57) ABSTRACT

A dual band antenna having a directive element and a reflective element is disclosed. A first and second antennas are arranged substantially parallel to each other and spaced between approximately 0.5-0.8 times the wavelength of the first antenna. The dual band antenna provides high gain at the zenith and at the horizon and enable v variation in the antenna beam shape as well as a reduction in cross polarization.

10 Claims, 3 Drawing Sheets

DUAL BAND DIRECTIVE/REFLECTIVE ANTENNA

FIELD OF THE INVENTION

The present invention is related to dual band antennas and, more particularly, to an dual band antenna having a directive element and a reflective element.

BACKGROUND OF THE INVENTION

The Indian Regional Navigational Satellite System (IRNSS) is an autonomous regional satellite navigation system developed by the Indian Space Research Organization (ISRO) as an alternative global navigation satellite system (GNSS) to the Global Positioning System controlled by the United States government. As currently planned, the IRNSS will consist of a special positioning service and a precision service. Both of these services will be carried on the L5 band at 1176.45 MHz and the S band at 2492.08 MHz.

It is desirous that antennas for use with the IRNSS have a high gain at the zenith, as well as significant gain near the horizon, e.g., at approximately 10-15 degrees of elevation. Conventional antennas may have significant gain at the zenith or may have significant gain near the horizon. However, conventional antennas for use with a GNSS typically do not have high gains at both the zenith as well as at the horizon. L and S band antenna systems are known in the art. However, there is needed a suitable dual band antenna system having the desired gain for use with the IRNSS.

SUMMARY OF THE INVENTION

The disadvantages of the prior art are overcome by providing a dual-band antenna comprising of a first antenna and a second antenna arranged substantially parallel to each other and spaced at a predefined distance apart. Illustratively, the first antenna operates at a higher frequency than the second antenna. The first and second antennas are illustratively spaced between approximately 0.5-0.8 times the length of the wavelength of the first antenna. The arrangement enables the first antenna to serve as a director to the second antenna, while the second antenna serves as a reflector to the first antenna. The dual band antenna provides high gain at the horizon as well as at the zenith. The arrangement enables variation in the antenna beam shape as well as a reduction in cross polarization.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
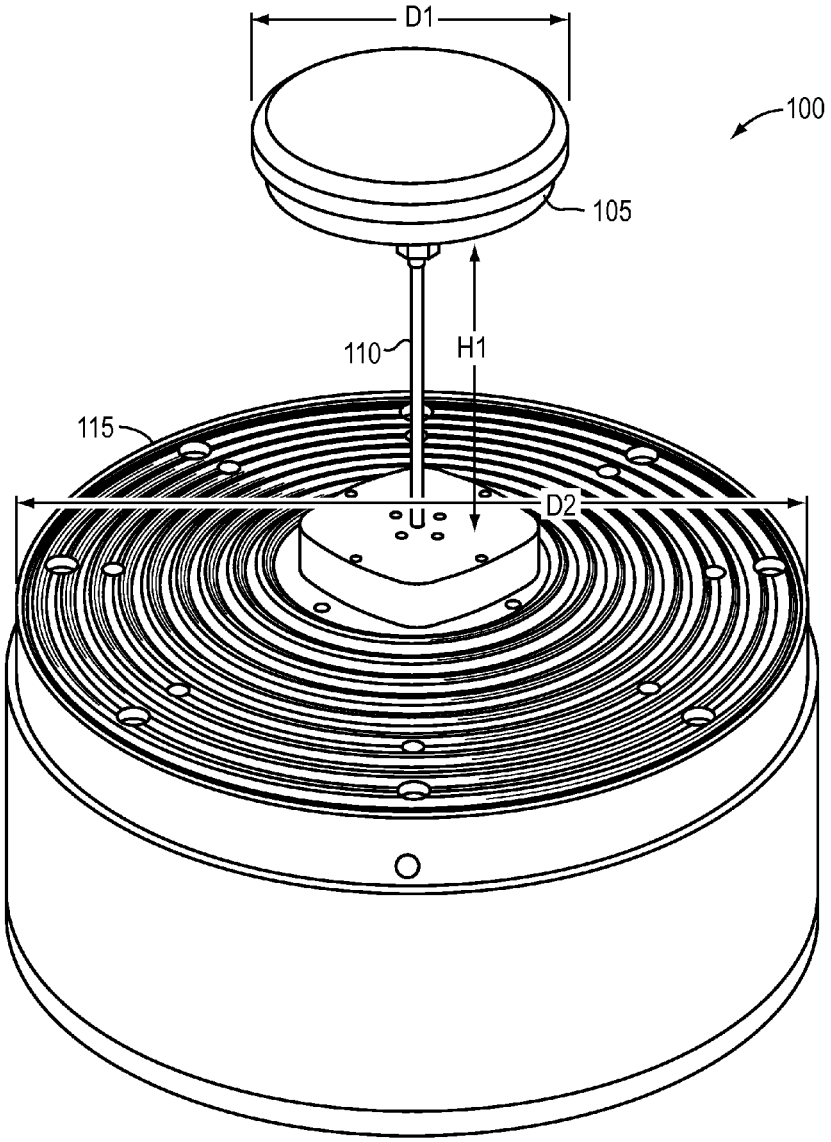
FIG. 1 is a perspective view of a dual band antenna in accordance with an illustrative embodiment of the present invention.

FIG. 1 is a perspective view of an exemplary dual band antenna 100 in accordance with an illustrative embodiment of the present invention. The antenna 100 illustratively comprises of a first antenna 105 that has a first ground plane having a first diameter D1 and a second antenna 115 having a second ground plane having a second diameter D2. In accordance with an illustrative embodiment of the present invention, antenna 105 and antenna 115 share a common center, i.e., the two antennas are orientated so that their center points (no shown) lie on a common line that is perpendicular to each of the ground places of the antennas.

The antennas 105, 115 are illustratively separated by a mast 110 having a height H1. It should be noted that in alternative embodiments, the antennas 105, 115 may be separated by other techniques other than a mast 110. For example, the antennas 105, 115 may be affixed to a mounting bracket (not shown) that keeps the two antennas separated by a distance of H1.

In accordance with an illustrative embodiment of the present invention, the first antenna 105 comprises an S-band (or higher frequency) antenna, while the second antenna 115 comprises an L-band (or lower frequency) antenna. Thus, the dual band antenna 100 would be suitable for use with the IRNSS. However, it should be noted that in alternative embodiments different band antennas may be utilized in accordance with the desired design requirements. As such, the description of L and S band antennas is should be taken as exemplary only.

Illustratively, the diameter D1 of the ground plane for the first antenna is approximately ½ the wavelength ( $\lambda 1$) of the frequency associated with the first antenna. That is:

$$D1 \approx 0.5\ \lambda 1$$

Similarly, the second diameter D2 is approximately half the wavelength ( $\lambda 2$) associated with the second antenna. That is:

$$D2 \approx 0.5\ \lambda 2$$

It should be noted that in an illustrative embodiment, D1 may exactly equal 0.5 $\lambda 1$ and D2 may exactly equal 0.5 $\lambda 2$; however, functional resonance may be obtained with values that are approximately equal to the exact values.

The height H1 of the mast 110 is illustratively between approximately 0.5-0.8 $\lambda 1$, i.e., between approximately 50-80% of the wavelength of the first antenna 105. Variations in H1 may enable to beam of the antenna 100 to be shaped with concomitant gains. However, it has been found that the best gains occur between approximately 0.5 $\lambda 1$ and approximately 0.8 $\lambda 1$. The arrangement described herein reduces cross polarization between the two antennas. Further, the dual band antenna of the present invention also improves multipath rejection as compared to conventional dual band antennas.

By arranging the first and second antennas 105, 115 as described herein, their respective ground planes act as parasitic elements for the other antenna. That is, the ground plane for the first antenna 105 acts as a director for the second antenna 115. Similarly, the ground plane for the second antenna 115 acts as a reflector for the first antenna 105. Thus, each antenna serves both as an antenna for its respective band, but also as an element of a two element Yagi style antenna for the other antenna. As will be appreciated by those skilled in the art, the distance H1 between the two antennas may be varied to control the beam shape of the antennas.

Figure 2:
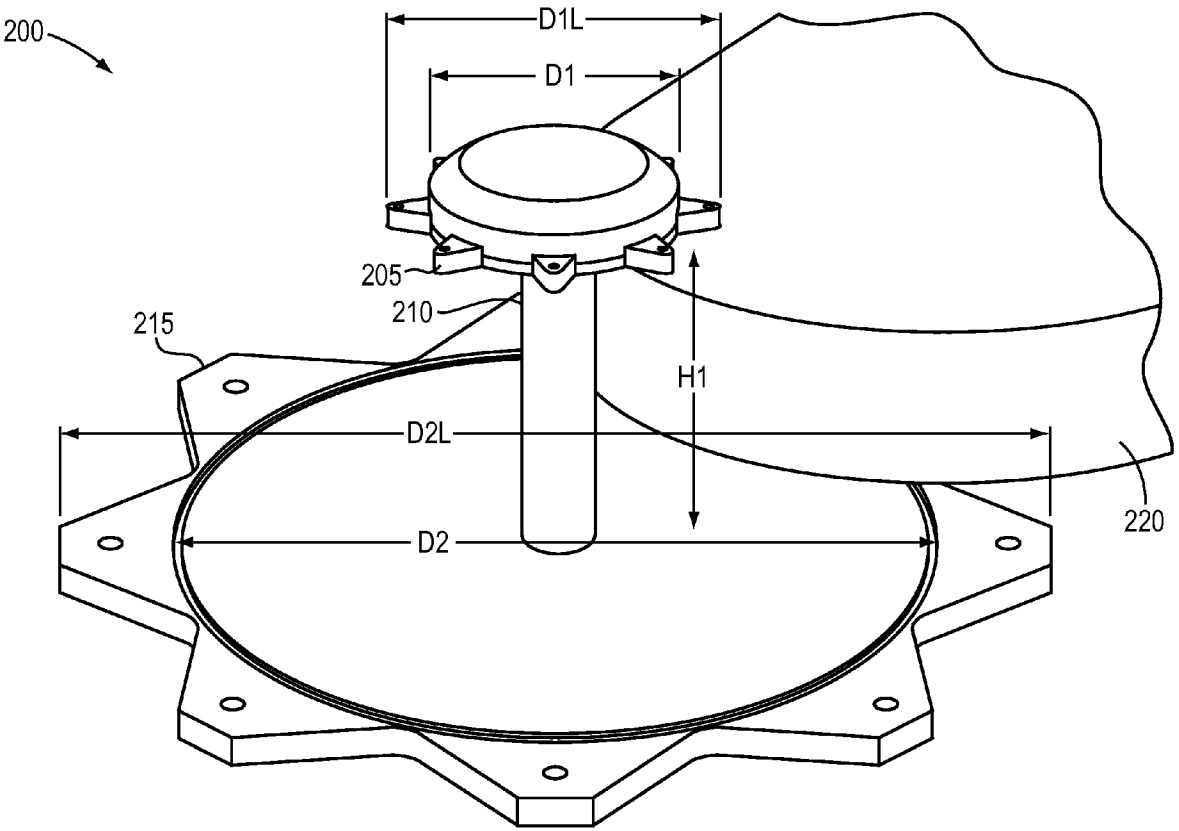
FIG. 2 is a perspective view of a dual band antenna having broadband ground planes in accordance with an illustrative embodiment of the present invention.

FIG. 2 is a perspective view of an exemplary dual band antenna 200 having broad band ground planes in accordance with an illustrative embodiment of the present invention. Antenna 200 illustratively comprises a first antenna 205 and a second antenna 215 separated by a mast having a height H1. As noted above in reference to antenna 100, the first and second antennas are illustratively arranged parallel to each other with their centers aligned on a common line.

In accordance with an illustrative embodiment of the present invention, the first antenna 205 comprises a broad band ground plane at a first diameter D1 and a second diameter D1L. Similarly, the second antenna 215 comprises of a broad band ground plane having a first diameter D2 and a second diameter D2L. As depicted in FIG. 2, the smaller diameters, i.e., D1 and D2, are shown as substantially circular, while the larger diameters (D1 L and D2L) are shown as star shaped having a plurality of points. It should be noted that the ground planes may have any shape as long as they are electronically sized to be approximately half of the wavelength desired. As such, the description of the larger ground planes as being star shaped should be taken as exemplary only.

In the exemplary dual band antenna 200 shown and described in reference to FIG. 2:

$$D1 \approx 0.5\ \lambda 1$$

$$D1L \approx 0.5\ \lambda 1L$$

$$D2 \approx 0.5\ \lambda 2$$

and $$D2L \approx 0.5\ \lambda 2L$$

As noted above, these values may be exactly equal; however, functional resonance may be obtained using values that are approximately equal to a half wavelength. As such, any description of values be exactly equal to half a wavelength should be taken as exemplary only.

The broad band ground planes enable the antennas to be utilized across a broad range of frequencies of a particular band with improved gain characteristics. For example, the L band ranges from 1-2 GHz. Similarly, the S band ranges from 2-4 GHz. In the example described above in reference to FIG. 2, the values for D1 and D1L may represent a half wavelength of two difference frequencies within the S band, while D2 and D2L may represent values representative of the half wavelength of two difference frequencies within the L band. Thus, if the antenna is receiving signals within the L band, the portion of the ground plane with diameter D2 may be closer to a half wavelength for frequencies that are higher. Similarly, that portion of the ground plane having diameter D2L may be closer to a half wavelength for lower frequencies.

Figure 3A:
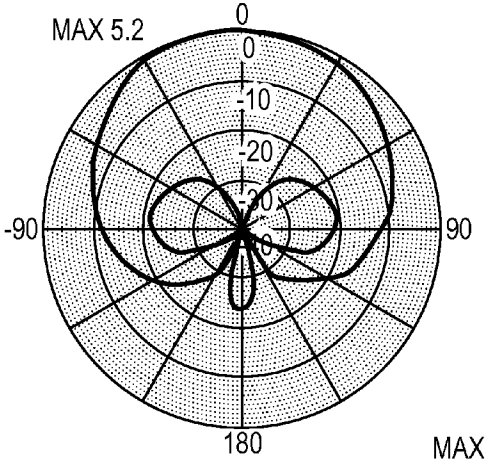
FIG. 3A is an exemplary diagram showing a gain of an exemplary antenna in accordance with an illustrative embodiment of the present invention.
Figure 3B:
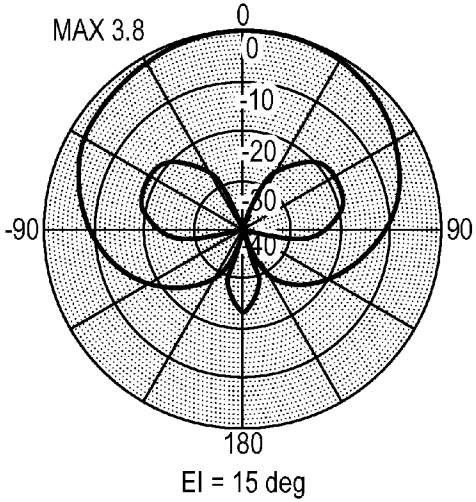
FIG. 3B is an exemplary diagram showing a gain of an exemplary antenna in accordance with an illustrative embodiment of the present invention.
Figure 3C:
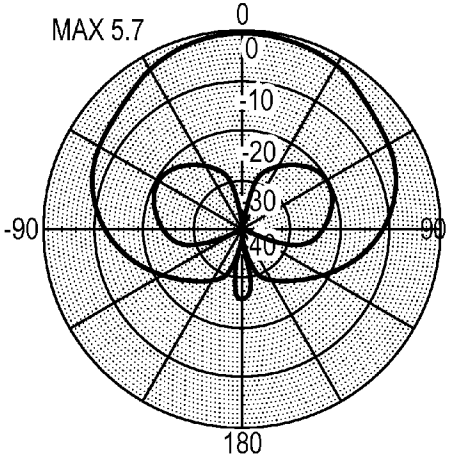
FIG. 3C is an exemplary diagram showing a gain of an exemplary antenna in accordance with an illustrative embodiment of the present invention.

FIG. 3A is an exemplary diagram showing a gain of an exemplary antenna in accordance with an illustrative embodiment of the present invention. Illustratively, FIG. 3A shows the gain of an exemplary first antenna, such as the S band antenna, without the reflector, i.e., the second antenna. That is, the gain shown is for a first antenna constructed without the reflector provided by the use of the second antenna. As can be seen from FIG. 3, the maximum gain is 5.2 db. FIG. 3B is an exemplary diagram showing a gain of an exemplary antenna in accordance with an illustrative embodiment of the present invention. FIG. 3B shows the gain of an exemplary dual band antenna in accordance with an illustrative embodiment of the present invention when the two antennas are located 0.6 λ1 apart. The maximum gain is 3.8 db. FIG. 3C is an exemplary diagram showing a gain of an exemplary antenna in accordance with an illustrative embodiment of the present invention. Specifically, FIG. 3C shows the gain when the two antennas are located 0.65 λ1 apart. The maximum gain is shown to be 5.7 db. Thus, by modifying the distance between the two antennas' ground planes, a substantial gain may be realized in both direction of on top (zenith) and near horizon.

While the present invention has been described in reference to particular exemplary embodiments, it will be understood that the present invention is by no means limited to the constructions and/or methods disclosed and/or shown in the drawings, but also comprises any modifications or equivalent within the scope of the claims. While this description has been written in terms of using an L and S band antennas, it should be noted that the principles of the present invention may be utilized with an L band or lower frequency band in conjunction with an S band or higher frequency band. Specifically, it is expressly contemplated that other sized antennas, other than L and S band antennas, may be utilized.

What is claimed is:

1. A dual band antenna, dual band antenna comprising:

a first antenna comprising of a first ground plane having a diameter that is approximately 0.5 λ1, wherein λ1 represents a wavelength associated with a first frequency;

a second antenna comprising of a second ground plane having a diameter of approximately 0.5 λ2, wherein λ2 represents a wavelength associated with a second frequency;

wherein the first and second ground planes are arranged substantially parallel to each other at a distance H, wherein H is between approximately 0.5 λ1 and approximately 0.8 λ1; and wherein the first ground plane acts as a director for the second antenna and wherein the second ground plane operates as a reflector for the first antenna.

2. The dual band antenna of claim 1 wherein the first ground plane comprises a broad band ground plane.

3. The dual band antenna of claim 1 wherein the second ground place comprises a broad band ground plane.

4. The dual band antenna of claim 1 wherein λ1 represents a frequency in an S band.

5. The dual band antenna of claim 1 wherein λ2 represents a frequency in a L band.

6. The dual band antenna of claim 1 wherein the first and second ground planes are affixed to a common mast.

7. The dual band antenna of claim 6 wherein the mast enables H to vary between approximately 0.5 λ1 and approximately 0.8 λ1, whereby a pattern of the dual band antenna is shaped by varying H.

8. The dual band antenna of claim 1 wherein cross polarization is reduced.

9. The dual band antenna of claim 1 wherein λ1 represents a frequency in band higher than an S band.

10. The dual band antenna of claim 1 wherein λ2 represents a frequency in a band lower than a L band.

* * * * *

UNITED STATES PATENT AND TRADEMARK OFFICE

CERTIFICATE OF CORRECTION

PATENT NO. : 9,257,756 B2
APPLICATION NO. : 14/041976
DATED : February 9, 2016
INVENTOR(S) : Son Huy Huynh It is certified that error appears in the above-identified patent and that said Letters Patent is hereby corrected as shown below:

In the Specification:

Col. 2, line 30 should read:
the description of L and S band antennas should be taken as Signed and Sealed this
Fourteenth Day of June, 2016

Michelle K. Lee

Michelle K. Lee
*Director of the United States Patent and Trademark Office*